US006550574B2

(12) United States Patent
Liu

(10) Patent No.: US 6,550,574 B2
(45) Date of Patent: Apr. 22, 2003

(54) ACOUSTIC LINER AND A FLUID PRESSURIZING DEVICE AND METHOD UTILIZING SAME

(75) Inventor: Zheji Liu, Olean, NY (US)

(73) Assignee: Dresser-Rand Company, Olean, NY (US)

( * ) Notice: Subject to any disclaimer, the term of this patent is extended or adjusted under 35 U.S.C. 154(b) by 0 days.

(21) Appl. No.: 09/745,862

(22) Filed: Dec. 21, 2000

(65) Prior Publication Data

US 2002/0079158 A1 Jun. 27, 2002

(51) Int. Cl.[7] ..... E04B 1/82
(52) U.S. Cl. ..... 181/286; 181/292; 181/213
(58) Field of Search ..... 181/284, 286, 181/290, 292, 293, 295, 213, 214, 217

(56) References Cited

U.S. PATENT DOCUMENTS

| | | | | |
|---|---|---|---|---|
| 1,783,276 A | | 12/1930 | Bliss | |
| 1,972,563 A | | 9/1934 | Irvin | |
| 3,181,646 A | | 5/1965 | Edwards | |
| 3,360,193 A | | 12/1967 | Harris et al. | |
| 3,948,346 A | | 4/1976 | Schindler | |
| 4,135,603 A | | 1/1979 | Dean, III et al. | |
| 4,137,992 A | * | 2/1979 | Herman | 181/286 |
| 4,150,850 A | | 4/1979 | Doerfling | |
| 4,189,027 A | | 2/1980 | Dean, III et al. | |
| 4,190,131 A | | 2/1980 | Robinson | |
| 4,204,586 A | | 5/1980 | Hani et al. | |
| 4,241,806 A | | 12/1980 | Metzger | |
| 4,287,962 A | | 9/1981 | Ingard et al. | |
| 4,303,144 A | | 12/1981 | Wirt | |
| 4,421,455 A | | 12/1983 | Tomren | |
| 4,433,751 A | | 2/1984 | Bonneau | |
| 4,504,188 A | | 3/1985 | Traver et al. | |
| 4,848,514 A | | 7/1989 | Snyder | |
| 4,854,416 A | | 8/1989 | Lalikos et al. | |
| 4,926,963 A | | 5/1990 | Snyder | |
| 4,932,835 A | | 6/1990 | Sorokes | |
| 4,944,362 A | | 7/1990 | Motsinger et al. | |
| 4,947,958 A | | 8/1990 | Snyder | |
| 5,007,499 A | | 4/1991 | Ebbing et al. | |
| 5,014,815 A | | 5/1991 | Arcas et al. | |
| 5,025,888 A | | 6/1991 | Arcas et al. | |
| 5,099,566 A | | 3/1992 | Barrett | |
| 5,173,020 A | | 12/1992 | Ebbing et al. | |
| 5,173,021 A | | 12/1992 | Grainger et al. | |
| 5,249,919 A | | 10/1993 | Sishtla et al. | |
| 5,457,291 A | * | 10/1995 | Richardson | 181/293 |
| 5,644,918 A | | 7/1997 | Gulati et al. | |
| 5,919,029 A | | 7/1999 | Van Nostrand et al. | |
| 5,923,003 A | | 7/1999 | Arcas et al. | |
| 5,979,593 A | | 11/1999 | Rice et al. | |
| 6,082,489 A | * | 7/2000 | Iwao et al. | 181/286 |
| 6,135,238 A | | 10/2000 | Arcas et al. | |
| 6,290,022 B1 | * | 9/2001 | Wolf et al. | 181/292 |
| 6,309,176 B1 | * | 10/2001 | Periyathamby et al. | 415/119 |

OTHER PUBLICATIONS

International Searching Authority, Patent Cooperation Treaty, Notification of Transmittal of The International Search Report or the Declaration, International Application No. PCT/US01/02984, Apr. 27, 2001, 6 pages.

* cited by examiner

*Primary Examiner*—Khanh Dang
(74) *Attorney, Agent, or Firm*—Haynes and Boone, LLP.

(57) ABSTRACT

This invention relates to an acoustic liner for attenuating noise and consisting of a plurality of cells formed in a plate in a manner to form an array of resonators, and a fluid processing device and method incorporating same.

15 Claims, 2 Drawing Sheets

ACOUSTIC LINER AND A FLUID PRESSURIZING DEVICE AND METHOD UTILIZING SAME

This invention relates to an acoustic liner and a fluid pressurizing device and method utilizing same.

Fluid pressurizing devices, such as centrifugal compressors, are widely used in different industries for a variety of applications involving the compression, or pressurization, of a gas. However, a typical compressor produces a relatively high noise level which is an obvious nuisance to the people in the vicinity of the device. This noise can also cause vibrations and structural failures.

For example, the dominant noise source in a centrifugal compressor is typically generated at the locations of the impeller exit and the diffuser inlet, due to the high velocity of the fluid passing through these regions. The noise level becomes higher when discharge vanes are installed in the diffuser to improve pressure recovery, due to the aerodynamic interaction between the impeller and the diffuser vanes.

Various external noise control measures such as enclosures and wrappings have been used to reduce the relative high noise levels generated by compressors, and similar devices. These external noise reduction techniques can be relatively expensive especially when they are often offered as an add-on product after the device is manufactured.

Also, internal devices, usually in the form of acoustic liners, have been developed which are placed in the compressors, or similar devices, for controlling noise inside the gas flow paths. These liners are often based on the well-known Helmholtz resonator principle according to which the liners dissipate the acoustic energy when the sound waves oscillate through perforations in the liners, and reflect the acoustic energy upstream due to the local impedance mismatch caused by the liner. Examples of Helmholtz resonators are disclosed in U.S. Pat. Nos. 4,100,993; 4,135,603; 4,150,732;.4,189,027; 4,443,751; 4,944,362; and 5,624,518.

A typical Helmholtz array acoustic liner is in the form of a three-piece sandwich structure consisting of honeycomb cells sandwiched between a perforated facing sheet and a back plate. Although these three-piece designs have been successfully applied to suppress noise in aircraft engines, it is questionable whether or not they would work in fluid pressurizing devices, such as centrifugal compressors. This is largely due to the possibility of the perforated facing sheet of the liner breaking off its bond with the honeycomb under extreme operating conditions of the compressor, such as, for example, during rapid depressurization caused by an emergency shut down of the compressor. In the event that the perforated facing sheet becomes loose, it not only makes the acoustic liners no longer functional but also causes excessive aerodynamic losses, and even the possibility of mechanical catastrophic failure, caused by the potential collision between the break-away perforated sheet metal and the spinning impeller.

Therefore what is needed is a system and method for reducing the noise in a fluid pressurizing device utilizing a Hemholtz array acoustic liner while eliminating its disadvantages.

SUMMARY

Accordingly an acoustic liner is provided, as well as a fluid processing device and method incorporating same, according to which the liner attenuates noise and consists of a plurality of cells formed in a plate in a manner to form an array of resonators.

DETAILED DESCRIPTION

Figure 1:
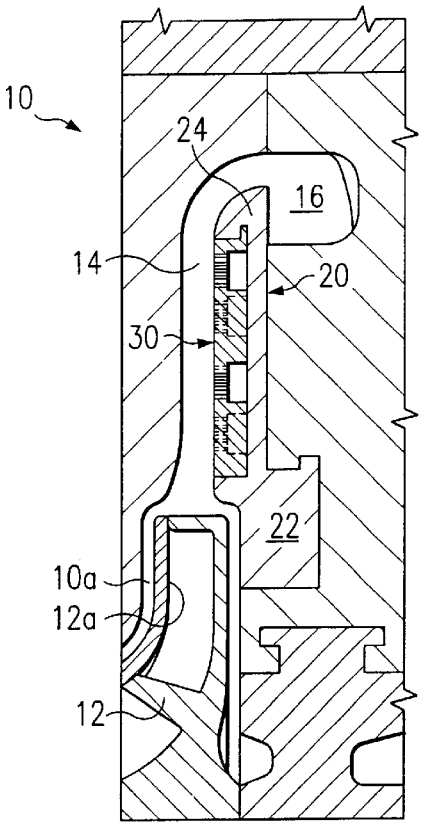
FIG. 1 is a cross-sectional view of a portion of a gas pressurizing device and an acoustic liner according to an embodiment of the present invention.

FIG. 1 depicts a portion of a high pressure fluid pressurizing device, such as a centrifugal compressor, including a casing 10 defining an impeller cavity 10*a* for receiving an impeller 12 which is mounted for rotation in the cavity. The impeller has openings, or flow passages, formed therethrough, one of which is shown by the reference numeral 12*a*. A diffuser channel 14 is provided in the casing 10 radially outwardly from the chamber 10*a* and the impeller 12, and receives the high pressure fluid from the impeller before it is passed to a volute, or collector, 16 for discharge from the device. Since this structure is conventional, it will not be shown or described in any further detail.

A mounting bracket 20 is secured to an inner wall of the casing 10 defining the diffuser channel and includes a base 22 disposed adjacent the outer end portion of the impeller and a plate 24 extending from the base and along the latter wall of the casing.

Figure 2:
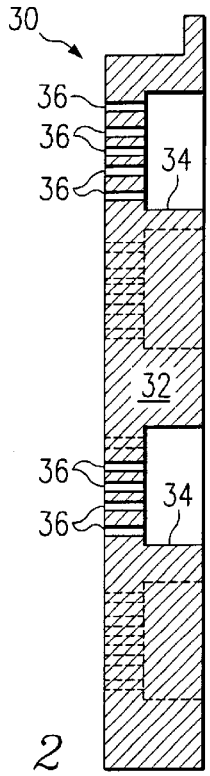
FIG. 2 is an enlarged cross-sectional view of the acoustic liner of FIG. 1.
Figure 3:
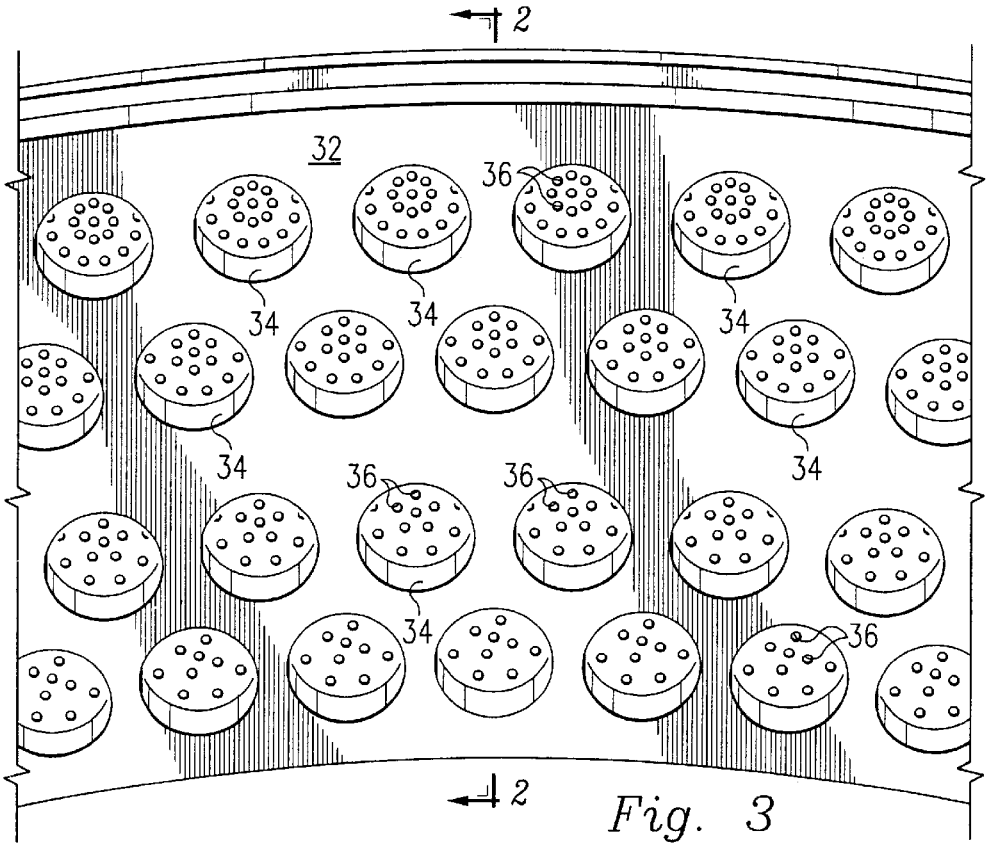
FIG. 3 is an enlarged elevational view of a portion of the liner of FIGS. 1 and 2.

A one-piece, unitary, annular acoustic liner 30 is mounted to the bracket 20 with its upper section being shown in detail in FIGS. 2 and 3. The liner 30 is formed of an annular, relatively thick, unitary shell, or plate 32 which is secured to the plate 24 of the bracket 20 in any known manner. The plate 32 is preferably made of steel, and is attached to the bracket plate 24 by a plurality of equally-spaced bolts, or the like. The liner 30 is annular in shape and extends around the impeller 12 for 360 degrees.

A series of relatively large cells, or openings, 34 are formed through one surface of the plate 32 and extend through a majority of the thickness of the plate but not through its entire thickness. A series of relatively small cells 36 extend from the bottom of each cell 34 to the opposite surface of the plate 32. Each cell 34 is shown having a disc-like cross section and each cell 36 is in the shown in the form of a bore for the purpose of example, it being understood that the shapes of the cells 34 and 36 can vary within the scope of the invention.

According to one embodiment of the present invention, each cell 34 is formed by drilling a relative large-diameter counterbore through one surface of the plate 32, which counterbore extends through a majority of the thickness of the plate but not though the complete thickness of the plate. Each cell 36 is formed by drilling a bore, or passage, through the opposite surface of the plate 32 to the bottom of a corresponding cell 34 and thus connects the cell 34 to the diffuser channel 14.

As shown in FIG. 3, the cells 34 are formed in a plurality of annular extending rows along the entire annular area of the plate 32, with the cells 34 of a particular row being staggered, or offset, from the cells of its adjacent row(s). A plurality of cells 36 are associated with each cell 34 and the cells 36 can be randomly disposed relative to their corresponding cell 34, or, alternately, can be formed in any pattern of uniform distribution.

The liner 30 is installed on the inner wall of the plate 24 of the bracket 20 so that the open ends of all the cells 34 are capped by the underlying wall of the plate. Due to the firm contact between the plate 32 of the liner and the bracket plate 24, and due to the cells 36 connecting each cell 34 to the diffuser area, the cells work collectively as array of Helmholtz acoustic resonators. Thus, the sound waves generated in the casing 10 by the high-rotation of the impeller 12, and by its associated components, are attenuated as they pass by the liner 30.

Moreover, the dominant noise component commonly occurring at the blade passing frequency, or other high frequency can be effectively lowered by tuning the liner 30 so that its maximum sound attenuation occurs around the latter frequency. This can be achieved by varying the volume of the cells 34, and/or the cross-section area, the number, and/or the length of the cells 36 to tune the liner. Thus, a maximum amount of attenuation of the acoustic energy generated by the rotating impeller 12 and its associated components can be achieved.

Figure 4:
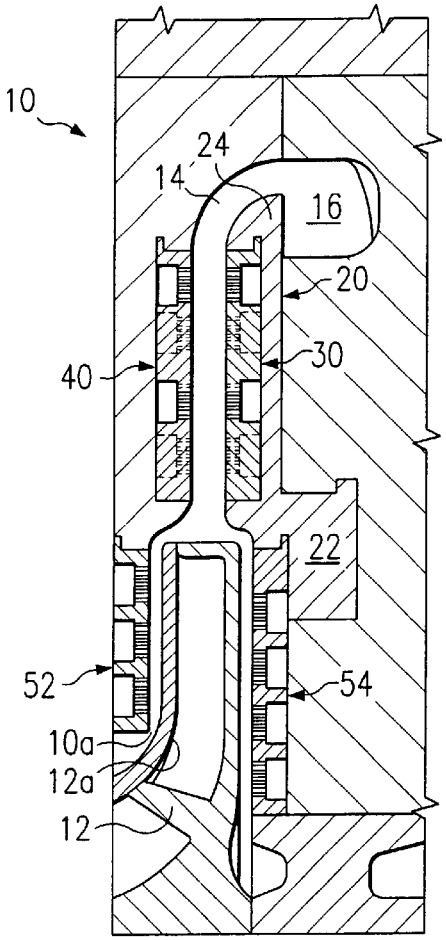
FIG. 4 is a view similar to that of FIG. 1, but depicting additional acoustic liners disposed at other locations in the fluid pressurizing device.

According to the embodiment of FIG. 4, an additional one-piece, unitary, annular liner 40 is provided on the internal wall of the casing 10 opposite the bracket plate 24 and defining, with the bracket plate, the diffuser channel 14. To this end, the latter wall is cut out as shown to accommodate the liner 40, which is identical to the liner 30 and therefore will not be described in detail. The liner 40 functions in an identical manner as the liner 30 as discussed above, and thus also contributes to a significant reduction of the noise generated by the impeller 12 and its associated components.

FIG. 4 also depicts two additional one-piece, unitary, annular liners 52 and 54 located at other preferred locations in the casing 10, i.e., to the front and the rear of the impeller 12. To this end, the corresponding portions of the internal walls of the casing 10 that houses the impeller 12 are cut out as shown to accommodate the liners 52 and 54. The liners 52 and 54 have a smaller outer diameter than the liners 30 and 40 and otherwise are identical to the liners 30 and 40. The liners 52 and 54 thus function in an identical manner as the liner 30 as discussed above, and thus contribute to a significant reduction of the noise generated in the casing 10.

The above-described preferred locations of the liners 30, 40, 52, and 54 enjoy the advantage of optimum noise reduction, since the liners are relatively close to the source of the noise, and therefore reduce the possibility that the noise will by-pass the liners and pass through a different path.

Figure 5:
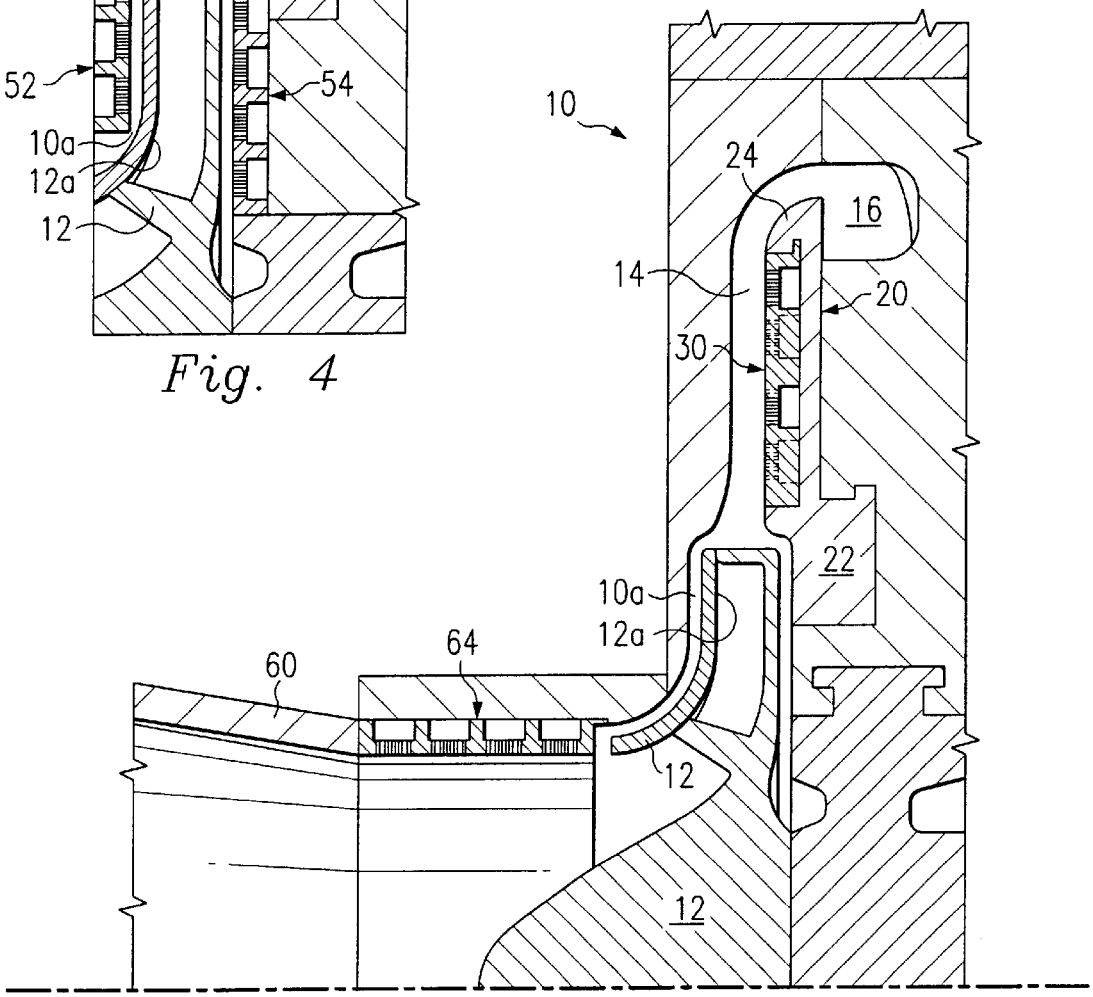
FIG. 5 is a view similar to that of FIG. 1, but depicting another acoustic liner disposed around the inlet duct of the fluid pressurizing device.

Still another preferred location for a liner is shown in FIG. 5 which depicts an inlet conduit 60 that introduces gas to the inlet of the impeller 12. The upper portion of the conduit 60 is shown extending above the centerline C/L of the conduit and the casing 10, as viewed in FIG. 5.

A one-piece, unitary, liner 64 is flush-mounted on the inner wall of the conduit 60 with the radial outer portion being shown. The liner 64 is in the form of a curved shell, preferably cylindrical in shape, is disposed in a cut-out recess of the inner surface of the conduit 60, and is attached in the recess in any known manner. Since the liner 64 is otherwise identical to the liners 30, 40, 52, and 54, it will not be described in further detail. The liner 64 also functions in an identical manner as the liner 30 as discussed above, and contributes to a significant attenuation of the noise in the casing 10.

It is understood that the liners 40, 52, 54 and 64 can be tuned to the impeller blade passing frequency to increase the noise reduction as discussed above in connection with the liner 30.

There are several advantages associated with the foregoing. For example, the liners 30, 40, 52, 54, and 64 are located to attenuate a maximum amount of noise near its source. Also, due to their one-piece, unitary construction, the liners 30, 40, 52, 54, and 64 have fewer parts and are mechanically stronger when compared to the composite designs discussed above. Also, given the fact that the frequency of the dominant noise component varies with the compressor speed, the number of the smaller cells 36 per each larger cell 34 can be varied spatially across the liners 30, 40, 52, 54, and 64 so that the entire liner is effective to attenuate noise in a broader frequency band. Consequently, the liners 30, 40, 52, 54, and 64 can efficiently and effectively attenuate noise, not just in constant speed machines, but also in variable speed compressors, or other fluid pressurizing devices. The liners 30, 40, 52, 54, and 64 also provide a very rigid inner wall to the internal flow. Further, relative to the three-piece sandwich structure used in the traditional configuration of conventional Helmholtz array acoustic liners, as discussed above, the liners according to the above embodiments of the present invention have less or no deformation when subject to mechanical and thermal loading. Therefore, the liners 30, 40, 52, 54, and 64 have no adverse effect on the aerodynamic performance of a centrifugal compressor, even when they are installed in the narrow passages such as the diffusor channels, or the like, of a centrifugal compressor.

VARIATIONS

The specific arrangement and number of liners 30, 40, 52, 54, and 64 utilized are not limited to the number shown in FIGS. 1, 4 and 5. Thus, one or both of the liners 30 and 40 could be used in the diffuser channel 14, one or both of the liners 52 and 53 could be used around the impeller 12, and/or the liner 64 could be used around the inlet conduit 60, depending on the particular application.

The specific technique of forming the cells 34 and 36 can vary from that discussed above. For example, a one-piece liner can be formed in which the cells 34 and 36 are molded in the plate 32.

The relative dimensions and shapes of the cells 34 and/or 36 can vary within the scope of the invention, The number and the pattern of the cells 34 and 36 in the plate 32 can vary.

The liners 30, 40, 52, 54, and 64 are not limited to use with a centrifugal compressor, but are equally applicable to other relatively high pressure gas pressurizing devices.

Each liner 30, 40, 52, 54 can extend for 360 degrees around the axis of the impeller 12, and the liner 64 can extend for 360 degrees around the axis of the conduit 60; or each liner can be formed into segments which extend an angular distance less than 360 degrees. For example, each liner 30, 40, 52, 54 and 64 could be formed by two or four segments each of which extends for 180 degrees or 90 degrees, respectively, with each segment having the unitary, one piece cross-section as described.

The spatial references used above, such as "bottom", "inner", "outer", etc, are for the purpose of illustration only and do not limit the specific orientation or location of the structure Since other modifications, changes, and substitutions are intended in the foregoing disclosure, it is appropriate that the appended claims be construed broadly and in a manner consistent with the scope of the invention.

What is claimed is:

1. A fluid pressurizing device comprising:

a casing having an inlet, an outlet, and a plurality of walls defining a chamber between the inlet and the outlet;

an impeller mounted in the chamber and adapted to rotate to flow fluid from the inlet, through the chamber, and to the outlet for discharge from the casing; and a plate mounted to one of the walls defining the chamber and having a plurality of through openings extending from one surface of the plate to the other; the one wall capping one end of the openings to form an array of resonators to attenuate the acoustic energy generated in the chamber.

2. The device of claim 1 wherein the openings comprise a plurality of cavities extending from one surface of the plate which are capped by the new wall; and a plurality of resonator orifices extending from the opposite surface of the plate to each cavity.

3. The device of claim 1 wherein the diameters of the resonator orifices are smaller than the diameters of the cavities.

4. The device of claim 1 wherein one of the surfaces of the plate abuts the wall.

5. The device of claim 1 wherein the impeller has a plurality of flow passages in fluid flow communication with the chamber, so that the fluid flows through the passages.

6. The device of claim 1 wherein the chamber includes an area for receiving the impeller and a diffuser channel communicating with the area, wherein the plate is mounted on a wall defining the diffuser channel; and wherein the fluid flows from the area to the diffuser channel.

7. The device of claim 1 wherein the openings are uniformly dispersed in the plate.

8. The device of claim 1 wherein the number and size of the openings are selected to tune the liner to attenuate the dominant noise component of the acoustic energy.

9. The device of claim 1 further comprising a plate mounted to another wall extending opposite the one wall and having a plurality of relatively through openings extending from one surface of the latter plate to the other; the other wall capping one end of the latter openings to form an array of resonators to attenuate the acoustic energy generated in the chamber.

10. The device of claim 9 wherein the latter openings include a plurality of cavities extending from one surface of the latter plate which are capped by the other wall; and a plurality of resonator orifices extending from the opposite surface of the later plate to each latter cavity.

11. The device of claim 10 wherein the diameters of the latter resonator orifices are smaller than the diameters of the latter cavities.

12. The device of claim 1 further comprising a conduit connected to the inlet, and a plate formed on the inner wall of the conduit and having a plurality of relatively through openings extending from one surface of the latter plate to the other; the inner wall of the conduit capping one end of the openings to form an array of resonators to attenuate the acoustic energy generated in the conduit.

13. The device of claim 12 wherein the plate is curved to conform with the inner surface of the conduit.

14. The device of claim 12 wherein the openings include a plurality of cavities extending from one surface of the latter plate which are capped by the conduit; and a plurality of resonator orifices extending from the opposite surface of the latter plate to each latter cavity.

15. The device of claim 14 herein the diameters of the latter resonator orifices are smaller than the diameters of the latter cavities.

* * * * *